US006015242A

United States Patent [19]

Gillis

[11] Patent Number: 6,015,242

[45] Date of Patent: Jan. 18, 2000

[54] SOAP HOLDING SCRUB PUFF

[76] Inventor: Christopher S. Gillis, 75 East Franklin St., Shavertown, Pa. 18708

[21] Appl. No.: 09/327,574

[22] Filed: Jun. 8, 1999

[51] Int. Cl.[7] ..... A47K 5/04; A47K 5/08

[52] U.S. Cl. ..... 401/201; 401/8

[58] Field of Search ..... 401/201, 8

[56] References Cited

U.S. PATENT DOCUMENTS

| | | | |
|---|---|---|---|
| 1,292,982 | 1/1919 | Wolf | 401/201 X |
| 2,817,865 | 12/1957 | Arioli | 401/201 |
| 3,167,805 | 2/1965 | Zuppinger et al. | 401/201 X |
| 3,674,374 | 7/1972 | Jennings | 401/201 X |
| 3,720,205 | 3/1973 | Liebman . | |
| 3,977,796 | 8/1976 | Gillespie et al. . | |
| 4,190,550 | 2/1980 | Campbell . | |
| 4,228,834 | 10/1980 | Desnick . | |
| 4,480,939 | 11/1984 | Upton . | |
| 4,789,262 | 12/1988 | Sanchez . | |
| 4,969,225 | 11/1990 | Schubert . | |
| 5,022,517 | 6/1991 | Benitez . | |
| 5,031,759 | 7/1991 | Ogilvie . | |
| 5,207,725 | 5/1993 | Pinkerton . | |
| 5,403,642 | 4/1995 | Landi et al. . | |

FOREIGN PATENT DOCUMENTS

| | | |
|---|---|---|
| 220394 | 5/1968 | Sweden . |

*Primary Examiner*—Steven A. Bratlie
*Attorney, Agent, or Firm*—David A. Tamburro

[57] ABSTRACT

A body cleansing puff, constructed of organic polymer netting, which contains a plurality of pieces of solid soap product. The puff is composed of multiple layers of organic polymer netting which serve several purposes including containment of the pieces of solid soap product and the formation of a convenient handle for hanging the device, the provision of surfaces for the production of soap lather, and the production of a product which imparts a mildly stimulating effect to the skin.

6 Claims, 3 Drawing Sheets

SOAP HOLDING SCRUB PUFF

BACKGROUND OF THE INVENTION

This invention relates generally to bathing and cleansing articles and more specifically to a novel body cleansing puff having solid soap pieces contained therein.

Body cleansing puffs, constructed from a bunched tube of organic polymer netting, are a common product of the health and beauty industry. These puffs require the application of a liquid soap or the rubbing against a piece of solid soap product to produce a lather, which is then used to cleanse the body. A common problem associated with this technique is that too little or too much soap may be applied to the puff which will either inadequately provide a sufficient quantity of lather or will result in wasting of excess soap product. Additionally, liquid soap is not efficiently converted to lather without dripping from the puff, which results in wasted soap product. Also, solid soap is subject to becoming slippery when wet and is easily dropped, creating a hazard in the shower from slipping on the soap or from having to bend over to pick up the slippery soap. Solid soap is also subject to produce soap slime when stored on a flat surface after wetting which results in accelerated degradation of the solid soap product.

Soap filled pads, such as those illustrated in U.S. Pat. Nos. 4,190,550, 4,789,262, 4,969,225, and 5,022,517, and soap holding bags illustrated in U.S. Pat. Nos. 4,228,834, 4,480,939, 5,031,759, and 5,207,725 have also been proposed as body cleansing aids. However, none of these various designs provides the aesthetically pleasing appearance of a puff, per se, while at the same time overcoming the above described problems associated with prior puffs.

The novel puff of the invention was developed to alleviate those problems.

SUMMARY OF THE INVENTION

A principal object of the present invention is to construct a body cleansing puff which contains integral pieces of a solid soap product.

Another object is to provide a body cleansing puff which contains the solid soap product within an inner tubular layer of organic polymer open mesh netting which holds the soap tightly until it is totally used, and has an outer tubular layer of organic polymer open mesh netting which forms the body of the puff.

A further object is to construct a body cleansing puff in which the solid soap product is contained in the approximate center of the puff so that migration of the soap to the outer surface of the puff netting is minimized or eliminated all together.

A further object is to create a body cleansing puff which has an integral bracelet/handle constructed of the same organic polymer netting which comprises the inner layer which holds the soap tightly within the approximate center of the puff.

A further object is to provide a convenient bracelet/handle which allows the puff to be easily held during use and also allows hanging of the puff between uses to provide for fast drying of the entire surface of the soap and the prolonging of the useful life of the solid soap product.

A further object is to create a body cleansing puff which is constructed entirely from organic polymer netting, which would be entirely recyclable as an organic polymer upon completion of its usefulness as a body cleansing puff.

Other objects and advantages will become apparent from the following detailed description of the invention, in the context of the drawings provided.

DETAILED DESCRIPTION OF THE INVENTION

Figure 1:
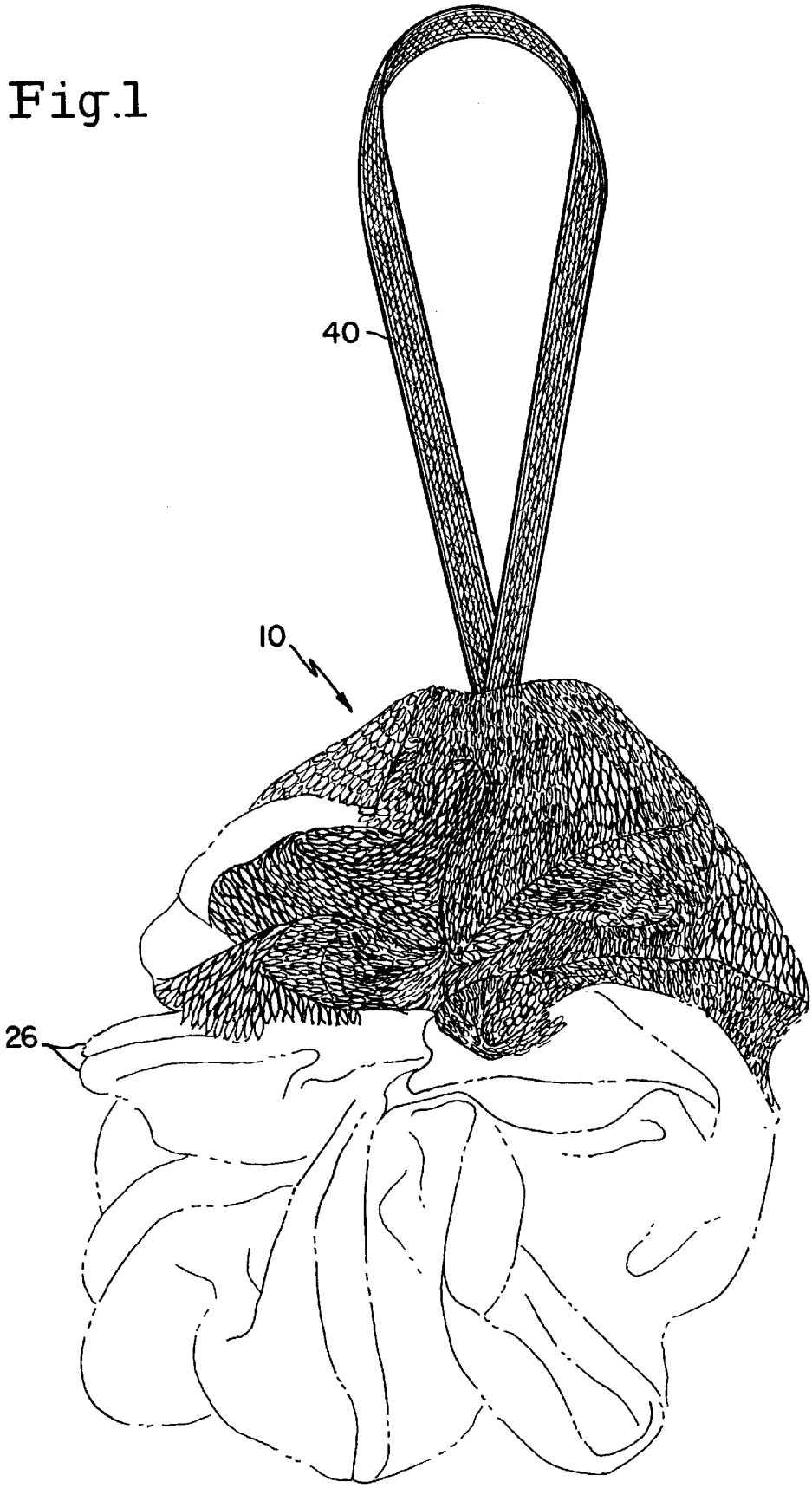
FIG. 1 is a generally perspective view of the novel cleansing puff of the invention.
Figure 2:
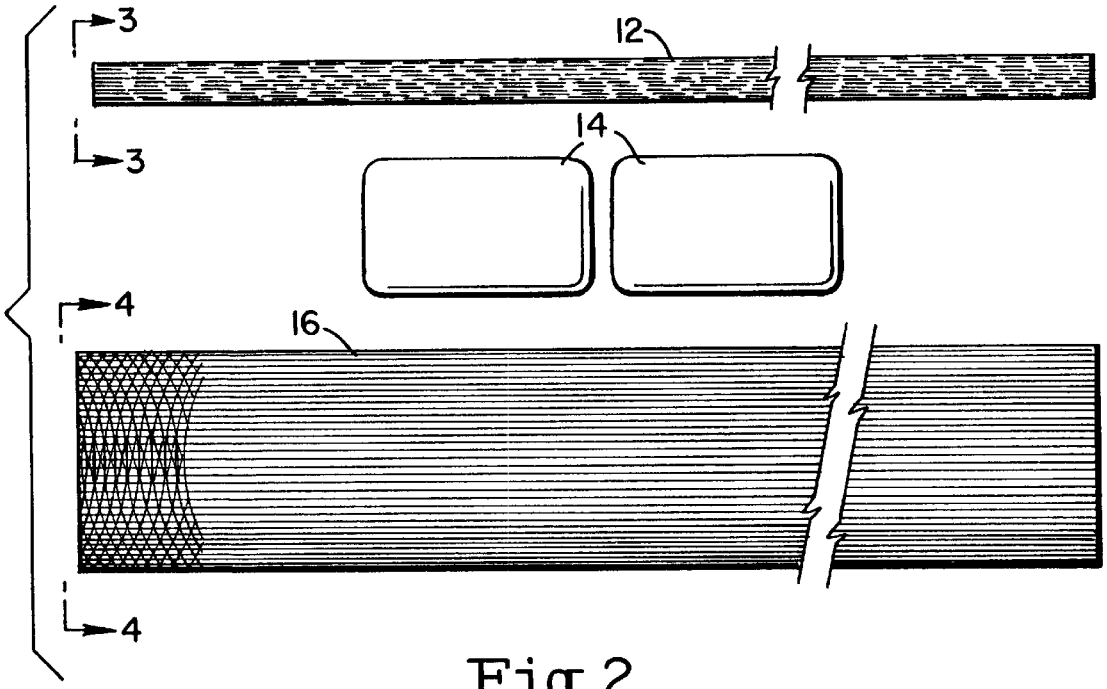
FIG. 2 is a generally exploded view illustrating the components from which the novel puff of FIG. 1 is manufactured.
Figure 3:
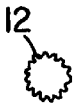
FIG. 3 is an end view of inner tubular layer or net taken along line 3—3 of FIG. 2.
Figure 4:
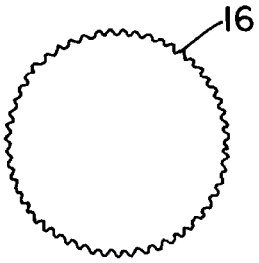
FIG. 4 is an end view of the outer tubular layer taken along line 4—4 of FIG. 2.

The novel cleansing puff 10 of the invention is illustrated in FIG. 1 and is manufactured by assembling the components shown in FIG. 2.

Puff 10 includes an inner tubular open mesh net 12, one or more pieces of solid soap 14 of rectangular shape, and an outer tubular open mesh net 16, with nets 12 and 16 being of recyclable, expandable elastic organic polymer material.

The diameter of tubular net 12, in its unexpanded state, is smaller then the width of soap piece 14, preferably within the range of one quarter to three quarters of the width. The preferred size of the soap pieces 14 is such that the total combined weight of the pieces will be between one quarter ounce and six ounces, depending upon whether the puff 10 is to be a limited use puff, or a body puff. The diameter of tubular net 16, in its unexpanded state, is larger than the width of soap pieces 14 and preferably is two to six times the width of pieces 14.

Figure 5:
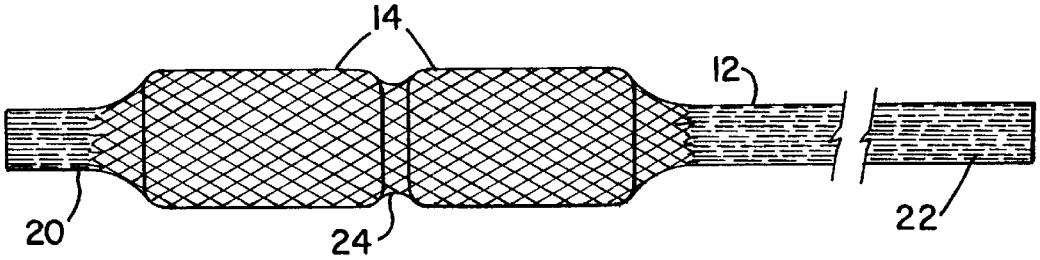
FIG. 5 is a top view illustrating the placement of the solid pieces of soap within the smaller diameter net.

The length of tubular net 12 is such that it can contain a plurality of soap pieces 14 (two pieces as shown in FIG. 5) placed end to end lengthwise in the net, plus up to about six inches beyond the soap pieces at one end 20 and up to about twenty four inches beyond the soap pieces at the other end 22. The length of tubular net 16 will vary from approximately three feet to fifteen feet, depending on the size of the puff desired.

Puff 10 is assembled by placing soap pieces 14 end-to-end within net 12, spaced apart at section 24, and located with respect to ends 20 and 22 as described above and shown in FIG. 5. Because the diameter of net 12 is smaller than the width of soap pieces 14, net 12 holds pieces 14 tightly in place so that the pieces can not move any significant amount radially or longitudinally in the net.

Figure 6:
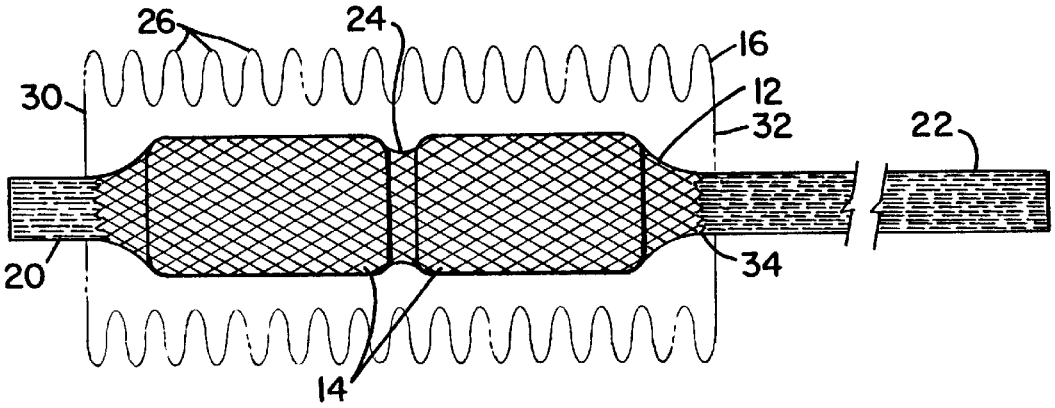
FIG. 6 is a top view illustrating the outer tubular layer or net gathered or bunched over the solid soap contained within the inner tubular net.
Figure 7:
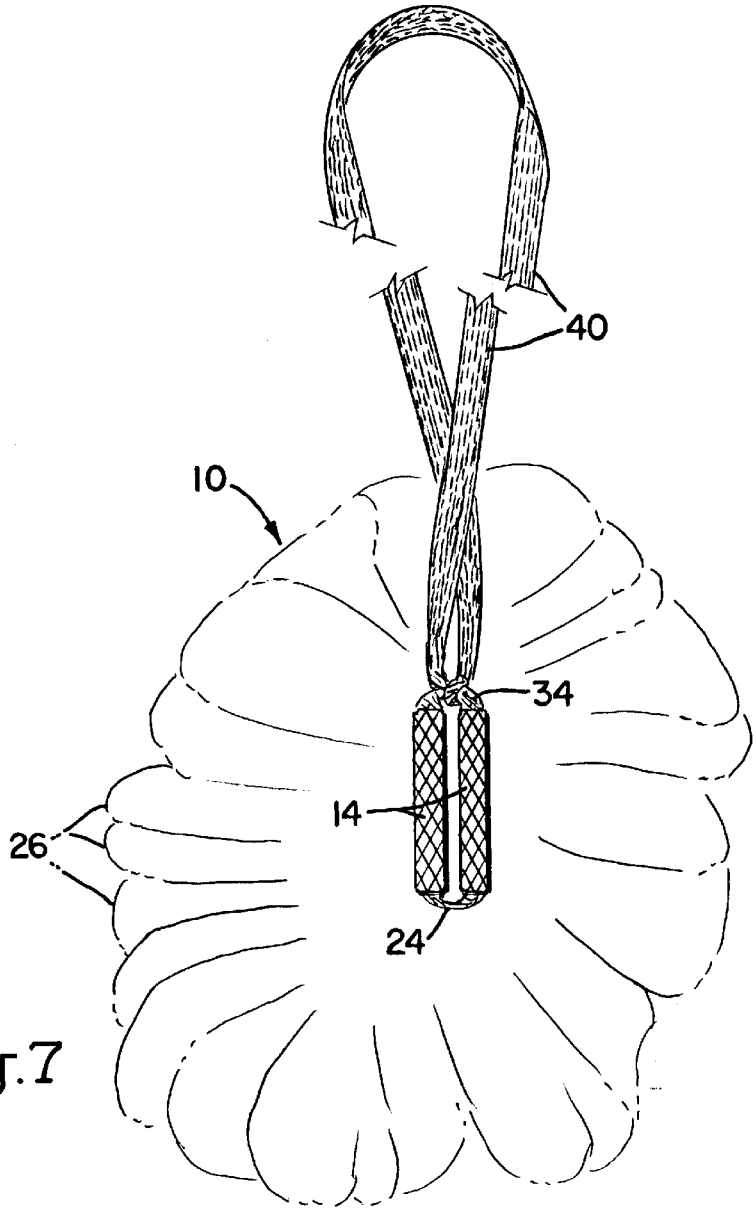
FIG. 7 is a fragmentary front sectional view of the puff of FIG. 1 illustrating the final configuration of the puff and handle and the positioning of the pieces of solid soap within the approximate center of the puff.

Next, as shown in FIG. 6, the subassembly of FIG. 5 is placed within the larger diameter outer net 16. Net 16 is then collapsed or bunched longitudinally in accordion fashion, forming a multitude of bends or folds 26 surrounding the approximate length of net 12 occupied by soap pieces l4. The short free end 20 of net 12 protrudes beyond one end 30 of bunched net 16 and the longer free end 22 of net 12 protrudes beyond the other end 32 of bunched net 16. In order to prevent migration of the ends 30 and 32 from the areas adjacent the ends of soap pieces 14, the free ends 20 and 22 of net 12 may be passed through openings in the mesh of the ends 30 and 32 of net 16 to effectively anchor the net around soap pieces 14.

To complete the fabrication of puff 10, the subassembly of FIG. 6 is then folded longitudinally back upon itself along the hollow net section 24, bringing end 20 of net 12 together with that portion 34 of end 22 immediately adjacent soap pieces 14. End 20 and portion 34 are then secured together by a tied knot or by heat sealing so that the soap pieces 14 are bound tightly end-to-end at both ends and can't move freely in any direction. This causes the bunched net 16 and bends 26 to assume an approximately circular puff configuration with the soap pieces 14 retained in approximately the center of the puff. If necessary, another length of narrow plastic netting can be wrapped around the outer perimeter of net 16, either horizontally or vertically, and secured to more tightly bind net 16 to the solid soap. In an actual puff, the soap pieces are hidden by the multitude of bends 26 emanating around the circular configuration.

The remaining extended length of end 22 is then looped back upon itself and the free end is tied or heat sealed to portion 34, thus forming a convenient bracelet/handle 40 which may be used to hold the puff during use or to hang the puff between uses. This provides an advantage in that the puff with integral soap can be easily handled during use, by placing the handle around the wrist, and will eliminate the possibility of dropping the slippery bar of wet soap. Additionally, by providing for a means of hanging the soap between uses will allow for quick drying of the entire surface of the pieces of soap. This will prevent the formation of soap slime which occurs from the prolonged contact of soap with a wet surface, and will substantially increase the useful life of the solid soap product.

Throughout the useful life of the puff 10, soap pieces 14 are retained within the approximate center of the puff, thus assuring uniform lathering accompanying the mildly stimulating effect of the netting to the skin.

In constructing nets 12 and 16, various types, textures, and colors of plastics may be used, including an antibacterial plastic. The connections between the mesh of plastic nets 12 and 16 may be by ties, hot glue, or heat welding.

Soap pieces 14 may be of various shapes. Similarly, various types of soaps may be used in varying amounts to accommodate varying uses, e.g. single-use, disposable devices for hotels, etc., or medium and long use for personal, commercial, or industrial purposes.

The forgoing relates to preferred exemplary embodiments of the invention, it being understood that other variants and embodiments thereof are possible within the spirit and scope of the invention, the latter being defined by the appended claims.

I claim:

1. A scrub article comprising inner tubular open mesh net, soap means contained within said inner tubular net, said inner tubular net having a diameter smaller than the size of said soap means so as to tightly retain said soap means therewithin, an outer tubular open mesh net having a diameter greater than the size of said soap means so that said inner tubular net fits within said outer tubular net, said outer tubular net having a length sufficient to enable it to be gathered longitudinally along said first tubular net and said soap means, said inner and outer tubular nets being folded longitudinally about themselves to form a puff around said soap means, the end portions of said inner tubular net adjacent said soap means being fastened together to retain said soap means in place.

2. The scrub article defined in claim 1, wherein one end of said inner tubular net extends from said puff and is looped back upon itself to form a handle for said puff.

3. The scrub article defined in claim 2, wherein said inner and outer tubular nets are secured together.

4. The scrub article defined in claim 2, comprising a third tubular net surrounding said puff.

5. The scrub article defined in claim 1, wherein said soap means comprises at least two-pieces of solid soap spaced end-to-end within said inner tubular net and substantially facing each other when said inner and outer tubular nets are folded upon themselves.

6. The scrub article defined in claim 1, wherein said inner and outer tubular nets are of an organic polymer material.

* * * * *